US012523031B2

(12) United States Patent
Hu

(10) Patent No.: US 12,523,031 B2
(45) Date of Patent: Jan. 13, 2026

(54) APPARATUS FOR RELEASING CLEANER IN FLUSH TOILET

(71) Applicant: Zhejiang Juhui Technology Development Co., Ltd, Shaoxing (CN)

(72) Inventor: Shuang'an Hu, Jinhua (CN)

(73) Assignee: Zhejiang Yuhou Forest New Materials Technology Co., Ltd., Jinhua (CN)

( * ) Notice: Subject to any disclaimer, the term of this patent is extended or adjusted under 35 U.S.C. 154(b) by 221 days.

(21) Appl. No.: 18/539,790

(22) Filed: Dec. 14, 2023

(65) Prior Publication Data

US 2025/0198144 A1 Jun. 19, 2025

(51) Int. Cl.
*E03D 9/03* (2006.01)
*E03D 9/02* (2006.01)

(52) U.S. Cl.
CPC ..... *E03D 9/038* (2013.01); *E03D 2009/028* (2013.01)

(58) Field of Classification Search
CPC ..... E03D 9/038; E03D 9/037; E03D 9/033; E03D 2009/028
USPC ..... 4/227.5
See application file for complete search history.

(56) References Cited

U.S. PATENT DOCUMENTS 2,980,277 A * 4/1961 Ganz, Jr. ..... E03D 9/033 215/383
3,698,021 A * 10/1972 Mack ..... E03D 9/037 4/227.3
5,734,996 A * 4/1998 Lee ..... E03D 9/037 137/433
6,748,610 B2 * 6/2004 Zach ..... E03D 9/037 4/227.7
2009/0235991 A1 * 9/2009 Nieh ..... E03D 9/037 222/559
2017/0130438 A1 * 5/2017 Shoval ..... E03D 1/33

* cited by examiner

*Primary Examiner* — Huyen D Le
(74) *Attorney, Agent, or Firm* — Westbridge IP LLC

(57) ABSTRACT

An apparatus for releasing a cleaner in a flush toilet is placed in a water tank of a flush toilet during use, and includes a container; the container is provided with an opening, and a cleaner is provided in the container. The apparatus includes a filling member; the filling member may extend into the container from the opening, and there is a gap between the filling member and the opening; the filling member or the container is connected to a floating body; relative movement between the container and the filling member occurs by means of a buoyancy effect, during the drawdown of the water, the filling member occupies more space in the container, and the water in the container flows out; and during the rising of the water, the water outside the container flows into the container, and the filling member occupies less space in the container.

16 Claims, 7 Drawing Sheets

APPARATUS FOR RELEASING CLEANER IN FLUSH TOILET

TECHNICAL FIELD

The present application relates to an apparatus for releasing a cleaner in a flush toilet.

BACKGROUND

For ease of cleaning, for the current flush toilet, a solid cleaner block is generally put into a water tank. The cleaner block is prepared by using cleaner compositions, and is dissolved by being directly put into the water tank of the toilet, such that the effect of cleaning and suppressing peculiar smell may be achieved every time the toilet is used for flushing.

However, the solid cleaner has disadvantages. When the flush toilet does not used for a long time, the cleaner block is dissolved in the water tank of the toilet, such that the entire water tank is filled with high-concentration cleaner, and the cleaner is used up in one flush, thus causing unnecessary waste.

SUMMARY

The technical problem to be solved by the present application is to provide an apparatus for releasing a cleaner in a flush toilet, so as to solve disadvantages in the related art.

The technical solution used in the present application provides an apparatus for releasing a cleaner in a flush toilet. The apparatus is placed in a water tank of a flush toilet during use, and includes a container; and the container is provided with an opening, and a cleaner is provided in the container. The apparatus includes a filling member; the filling member may extend into the container from the opening, and there is a gap between the filling member and the opening; the filling member or the container is connected to a floating body; a buoyancy effect of the rising and drawdown of water in the water tank on the container causes a relative movement between the container and the filling member, and a space that the filling member occupies the container changes; during the drawdown of the water, the filling member occupies more space in the container, and the water in the container flows out; during the rising of the water, the water outside the container flows into the container, and the filling member occupies less space in the container, and the container is provided with a through hole, and the through hole communicates with the opening via the space in the container.

The filling member is connected to the floating body, and the buoyancy effect of the rising and drawdown of the water in the water tank on the filling member causes the filling member to move up and down; and the container remains fixed to the water tank.

The container is connected to the floating body, and the buoyancy effect of the rising and drawdown of the water in the water tank on the container causes the container to move up and down; and the filling member remains fixed to the water tank.

The filling member is connected to a blocking portion; and after the water rises, the blocking portion is capable of blocking the opening from communicating with the outside.

The apparatus further includes a cylinder. Two ends of the cylinder penetrate through each other; one end of the cylinder is provided with a flange, which extends internally; the blocking portion is disposed in the cylinder; the flange covers the blocking portion; and the opening is blocked from communicating with the outside after the blocking portion is fitted to the flange.

The apparatus is connected to the container by means of the other end of the cylinder.

The other end of the cylinder is in threaded connection with the container.

The container is connected to a weight.

The filling member is guided to be connected to the container when being close to or away from the container.

The opening of the container faces downward.

The apparatus further includes a cover plate. An upper end of the filling member is fixedly connected to the cover plate by extending out of the cylinder.

The container is provided with a solid cleaner.

The through hole is below the opening; the hole diameter of the through hole is 0.1 mm to 12 mm; and the through hole is located in an upper middle section of the container.

The side of the cover plate that faces towards the container is provided with a surrounding edge that is exposed from the gap between the filling member and the opening; an external diameter of the cover plate is greater than an external diameter of the cylinder; the surrounding edge is at the periphery of the cylinder; and the surrounding edge or the cover plate is provided with a second through hole.

The second through hole is non-circular.

The second through hole has an overlap with the gap in a vertical straight line.

Compared with the related art, the present application has the following beneficial effects. The container in the present application is movably disposed with the filling member, movement between the container and the filling member may be caused by changes in a water level in the water tank, and the free space that the filling member occupies the container changes. By using the above mechanism, the discharging of a mixed cleaning solution in the container and the supplementary allocation of the mixed cleaning solution are realized, and the entire mechanism is simple.

DETAILED DESCRIPTION OF THE EMBODIMENTS

The present application is further described below with reference to the drawings and embodiments.

Figure 1:
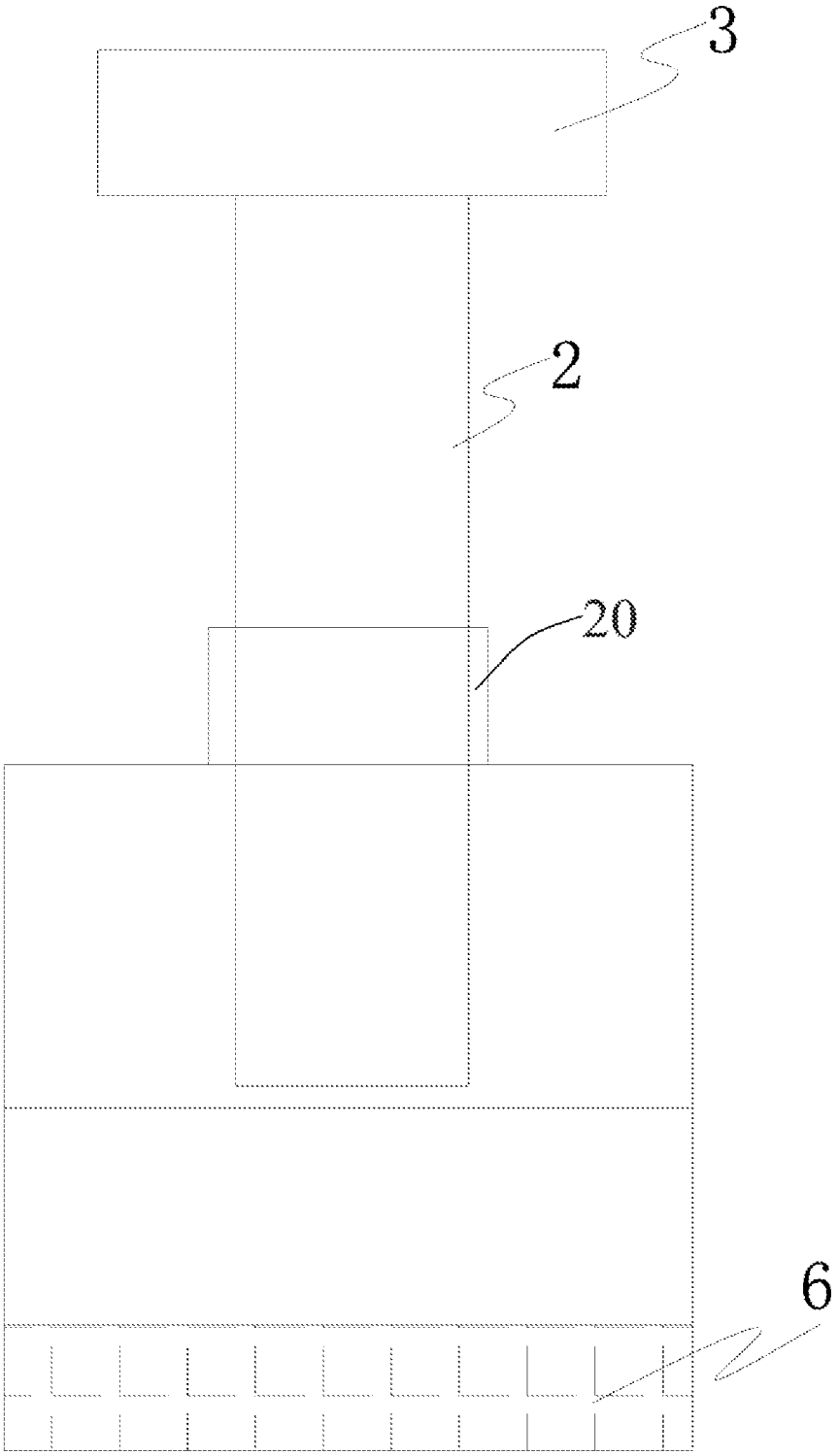
FIG. 1 is a schematic diagram of a structure according to the present application.
Figure 2:
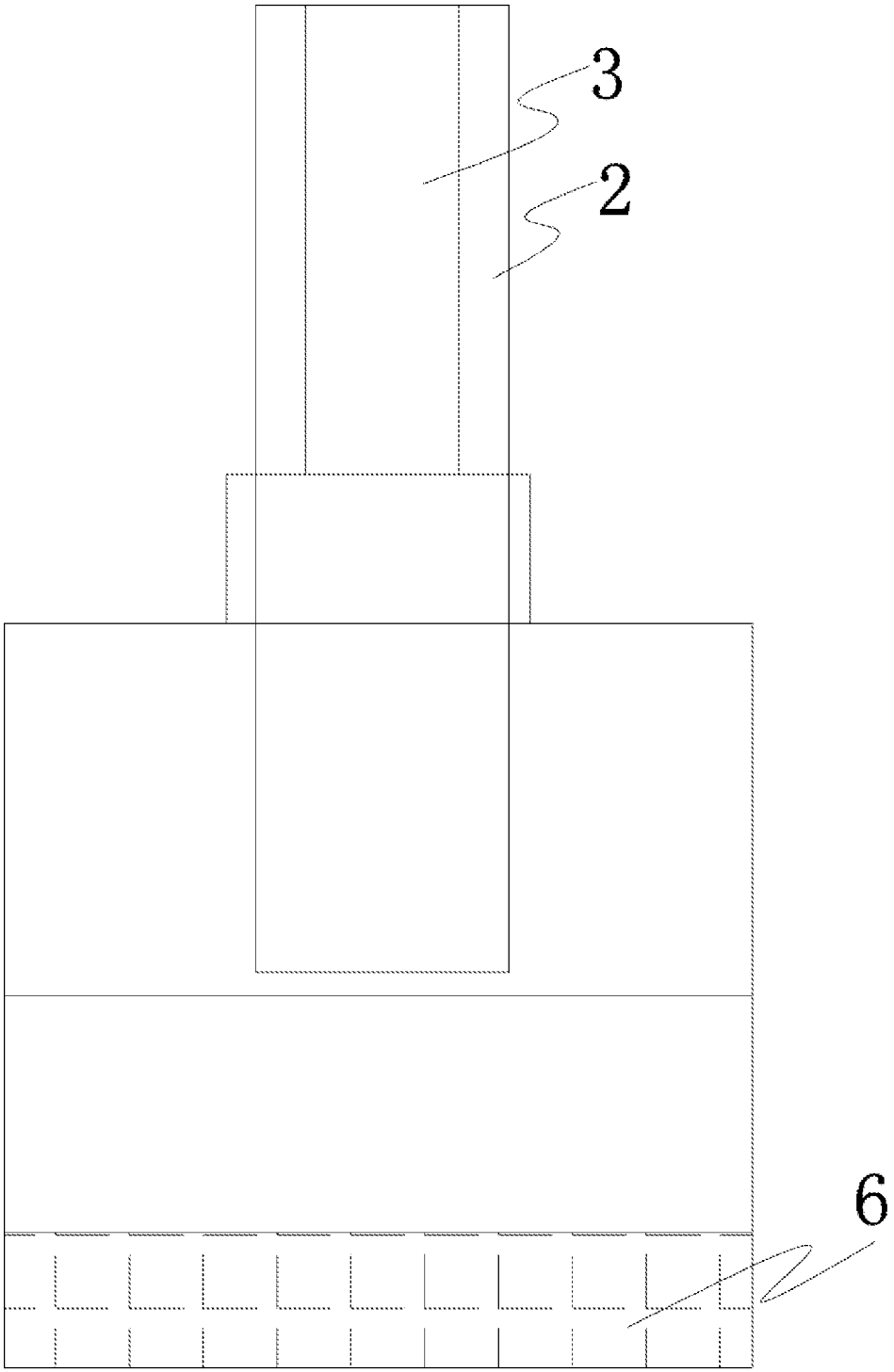
FIG. 2 is a schematic diagram of a structure according to Implementation II of the present application.
Figure 3:
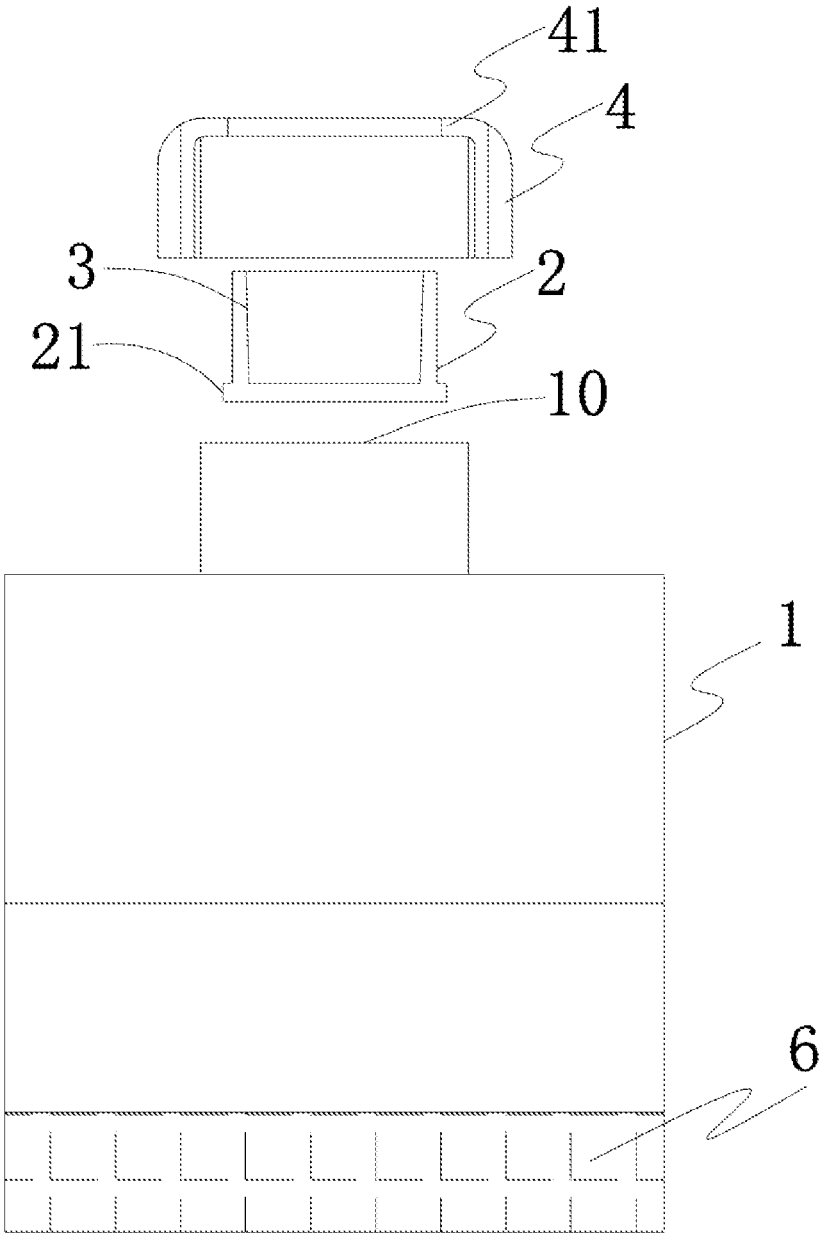
FIG. 3 is a schematic diagram of a structure according to Implementation III of the present application.
Figure 4:
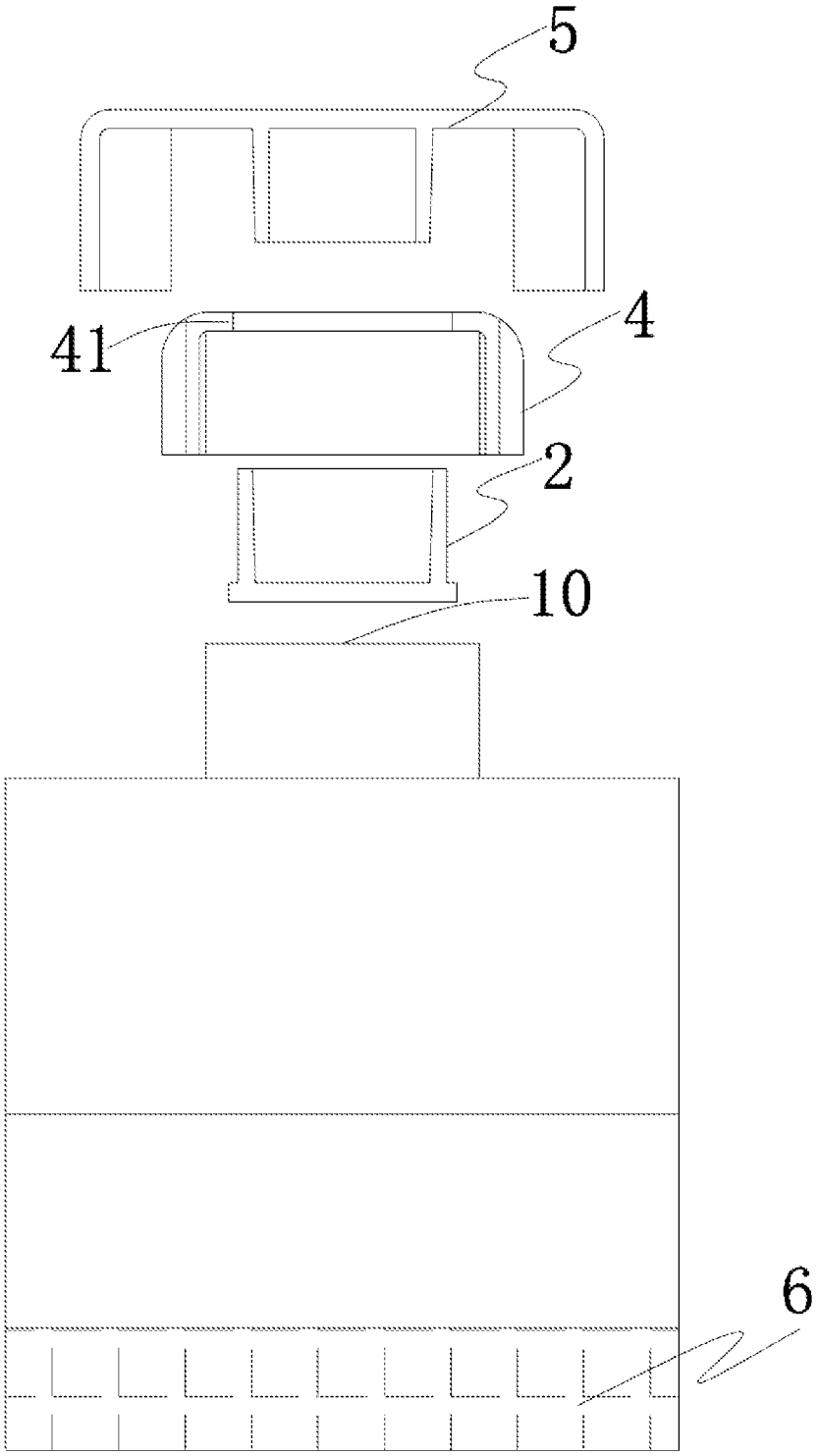
FIG. 4 is a schematic diagram of a structure according to Implementation IV of the present application.
Figure 5:
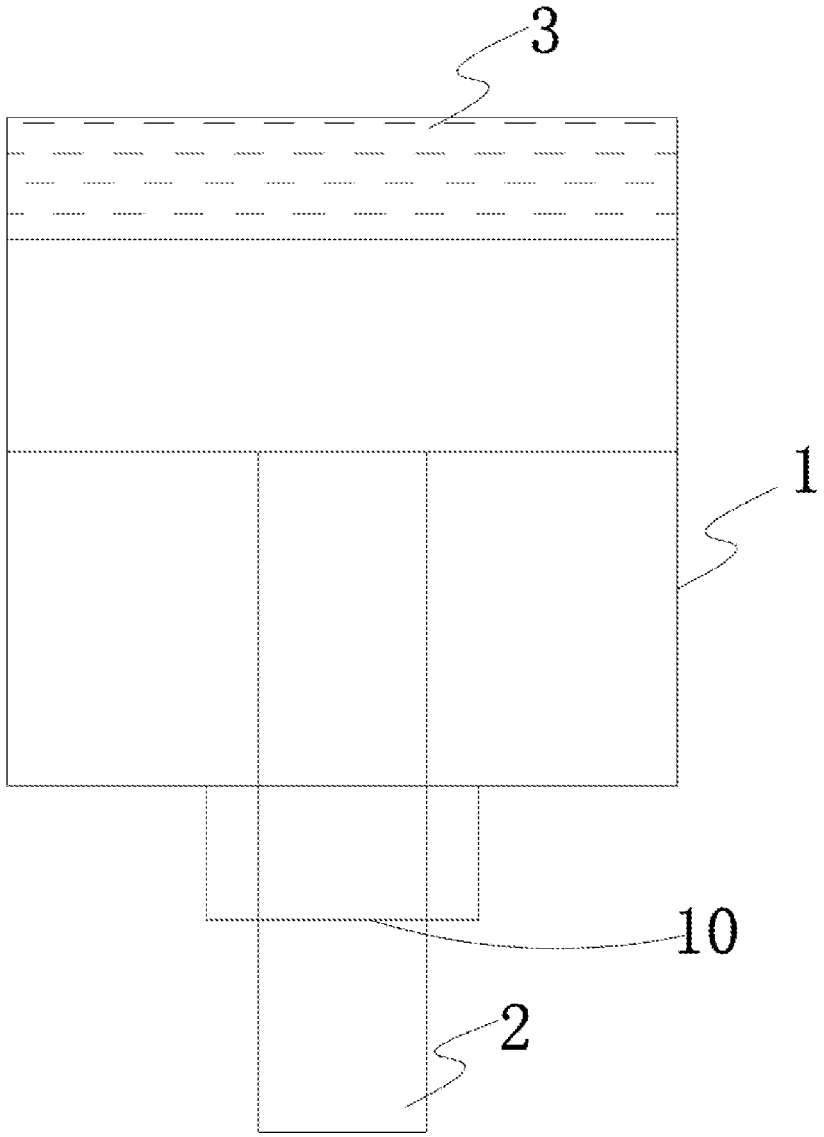
FIG. 5 is a schematic diagram of a structure according to Implementation V of the present application.
Figure 6:
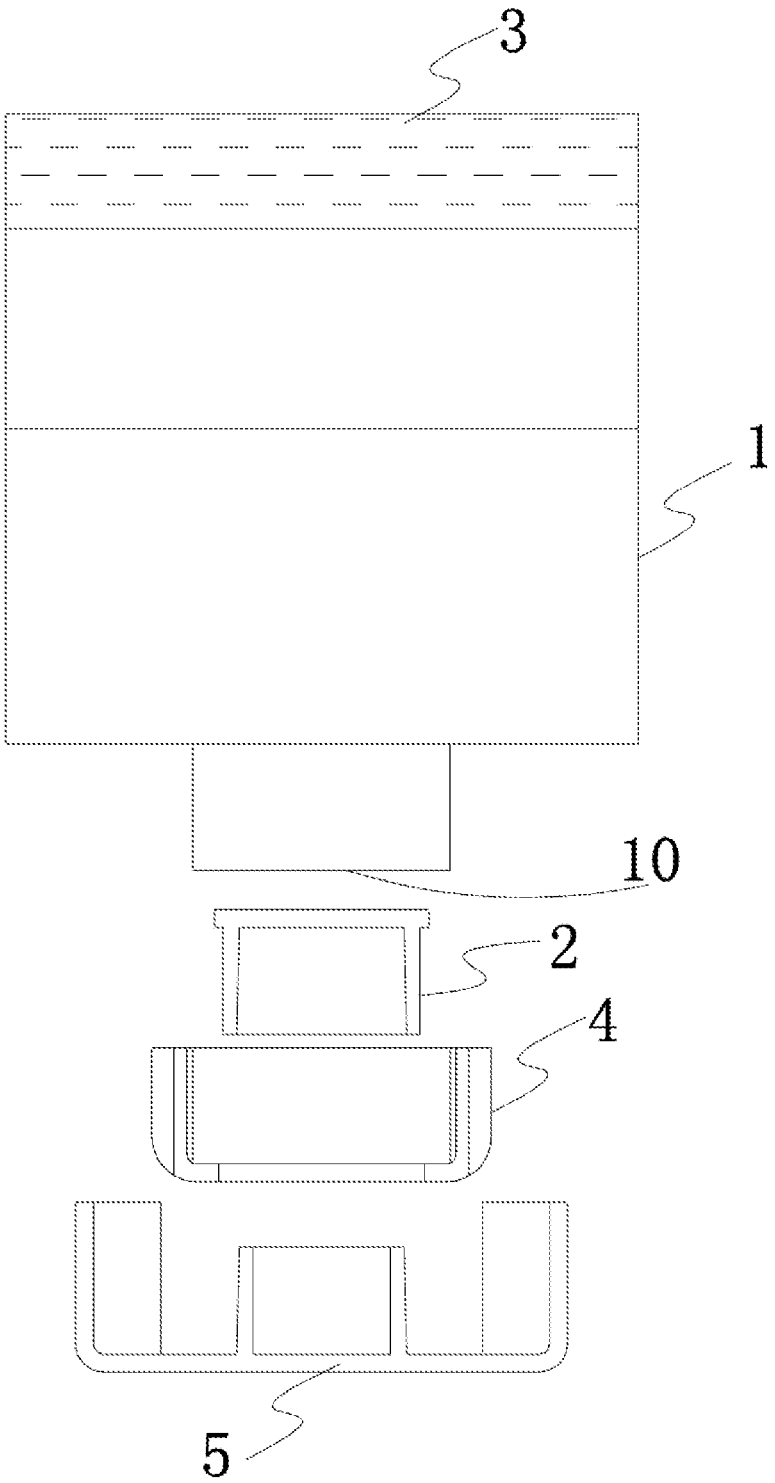
FIG. 6 is a schematic diagram of a structure according to Implementation VI of the present application.
Figure 7:
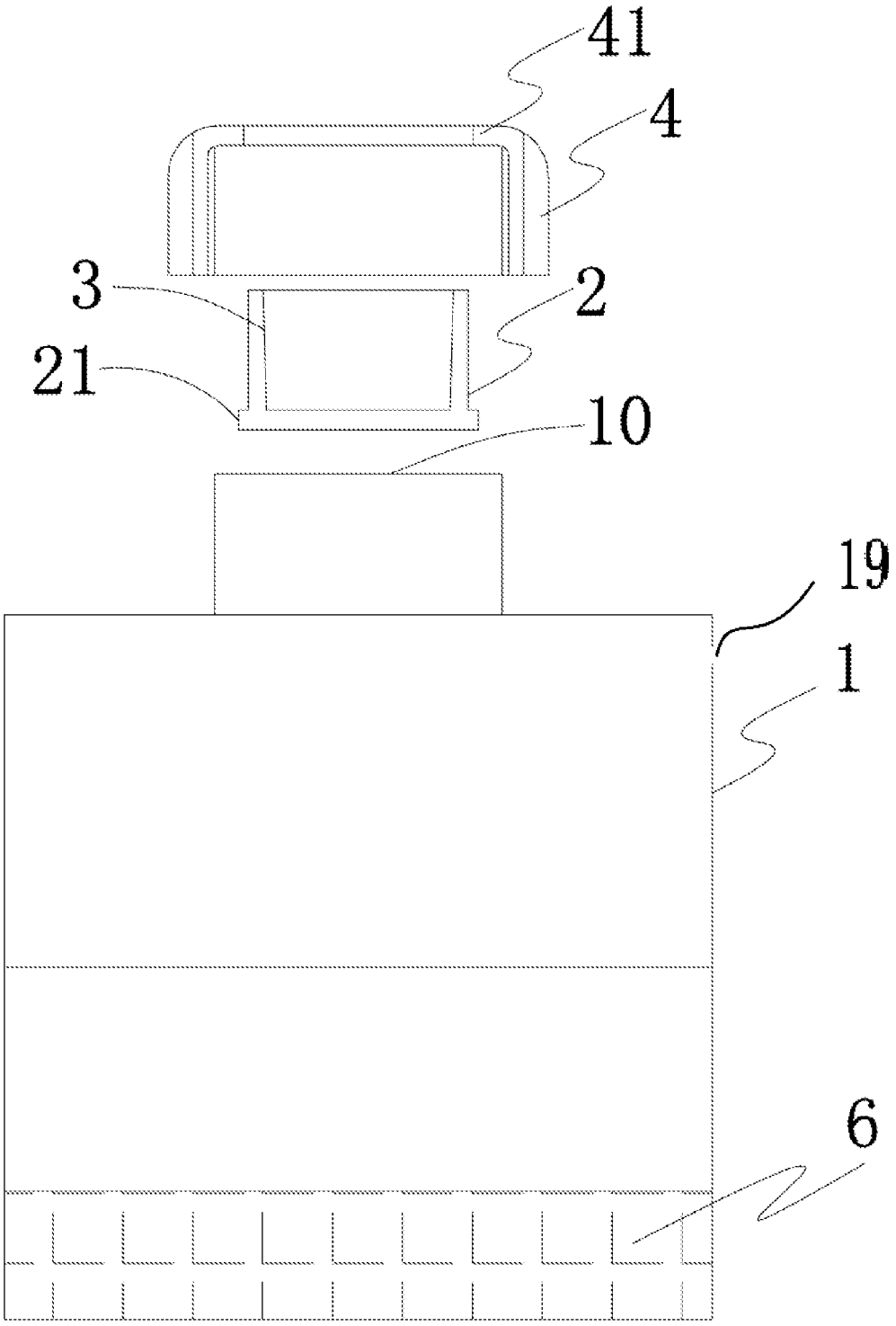
FIG. 7 is a schematic diagram of a structure according to Implementation VII of the present application.

As shown in FIGS. 1 to 6, an apparatus for releasing a cleaner in a flush toilet described in this embodiment is placed in a water tank of a flush toilet during use, and includes a container 1; the container 1 is provided with an opening 10, and a cleaner is provided in the container 1. The apparatus further includes a filling member 2; the filling member 2 may extend into the container 1 from the opening 10, and there is a gap 20 between the filling member 2 and the opening 10; the filling member 2 or the container 1 is connected to a floating body 3; a buoyancy effect of the rising and drawdown of water in the water tank on of the flush toilet, the container 1 or the filling member 2 causes a relative movement between the container 1 and the filling member 2, and a space that the filling member 2 occupies the container 1 changes; during the drawdown of the water, the filling member 2 occupies more space in the container 1, and the water in the container 1 flows out; and during the rising of the water, the water outside the container 1 flows into the container 1, and the filling member 2 occupies less space in the container 1. In this embodiment, the water level in the water tank rises and falls during use. At regular times, the water level in the water tank is high, water may be filled into the container 1 from the opening 10, until the container is full, and in this case, the filling member 2 or the container 1 is also located in a high position due to the buoyancy effect; during flushing, the water level decreases, and the filling member 2 moves downward due to the decreasing of the water level, such that more filling member 2 extends into the container 1 to cause the water in the container 1 to be externally discharged; or the container 1 moves downward, and more filling member 2 extends into the container 1 to cause the water in the container 1 to be externally discharged. During re-storing of the water, the water level rises, the water flows into the container 1, and the filling member 2 moves upward, and so on. The cleaner is preferably a solid cleaner. When a mixed solution is in a saturated state, the cleaner is no longer dissolved, such that the concentration of the mixed cleaning solution is equalized at each discharging. As shown in FIG. 7, in this embodiment, the container is provided with a through hole 19, and the through hole 19 communicates with the opening through the space in the container. The container is provided with the through hole 19. The through hole 19 is below the opening; the hole diameter of the through hole 19 is 0.1 mm to 12 mm; and the through hole 19 is located in an upper middle section of the container. There is a gap 20 between a filling member in the related art and an opening. The gap 20 is the only passage that water flows in and out a container. When a water level of a water tank of a toilet rises, and the water flows into the container via the gap 20, the gap 20 is sealed by the water; and if the buoyancy of a floating body is not strong enough, the filling member connected to the floating body may not float because the buoyancy cannot break the balance. The container is provided with the through hole 19, the through hole 19 communicates with the opening via the space in the container, and after the gap 20 is sealed by the water during the floating of the filling member, as the container is provided with the through hole 19, the problem of poor upward movement of the filling member caused by water seal is solved.

Preferably, in this embodiment, the filling member 2 is guided to be connected to the container 1 when being close to or away from the container. The filling member 2 and the container 1 are unable to be physically completely separated from each other. After the filling member 2 or the container 1 is driven by water floating, in order to achieve circulation, the filling member 2 is able to extend into the container 1 again after the water level falls. During specific implementation, the filling member 2 is long enough to remain extending into the container 1. Alternatively, that the filling member 2 is close to or away from the container 1 may be subjected to guiding limitation. For example, a guide sleeve is provided outside the filling member 2, the guide sleeve is connected to the opening 10, and the filling member 2 axially moves along the guide sleeve.

As a preferred implementation solution I, the filling member 2 is connected to the floating body 3, and the filling member 2 is subjected to the buoyancy effect due to the rising and drawdown of the water in the water tank, so as to cause the filling member 2 to move up and down; and the container 1 remains fixed to the water tank. The upward and downward buoyancy of the water level acts on the floating body 3. The floating body 3 includes customary techniques in the related art such as a lightweight buoyancy material or a hollow structure or an inflatable structure. In this embodiment, the mode that the filling member 2 is connected to the floating body 3 includes an integration mode. For example, the filling member 2 is selected as the buoyancy material, the inner core of the filling member 2 is hollow and may float in water, and the integration mode is not an omission of one of the technical features. Alternatively, the connection mode may also be a combined structure, for example, one portion is made of the buoyancy material or of the hollow structure, and the other portion is made of the filling member 2 material. All the above solutions belong to the fact that the filling member 2 is connected to the floating body 3. Preferably, the container 1 is heavy enough to remain fixed to the water tank, or the container 1 is positioned by means of clamping fixation. In a preferred implementation, the container 1 is connected to a weight 6. The weight 6 enables the container 1 to remain disposed to the water tank.

As a preferred implementation solution II, this implementation is the transposition of the preferred implementation solution I, since the container 1 is movable, the container 1 is connected to the floating body 3, and the container 1 is subjected to the buoyancy effect due to the rising and drawdown of the water in the water tank, so as to cause the container 1 to move up and down; and the filling member 2 remains fixed to the water tank. The upward and downward buoyancy of the water level acts on the floating body 3. The floating body 3 includes the customary techniques in the related art such as the buoyancy material or the hollow structure or the inflatable structure. In this embodiment, the mode that the container 1 is connected to the floating body 3 includes the integration mode. For example, the container 1 is selected as the buoyancy material, part of the container 1 is hollow and may float in water, and the integration mode is not an omission of one of the technical features. Alternatively, the connection mode may also be a combined structure, for example, the container 1 is connected to the buoyancy material or the hollow structure. All the above solutions belong to the fact that the container 1 is connected to the floating body 3. Preferably, in this embodiment, the opening 10 of the container 1 faces downward.

In this embodiment, the filling member 2 is connected to a blocking portion 21; and after the water rises, the blocking portion 21 may block the opening 10 from communicating with the outside. In this embodiment, the blocking portion 21 protrudes relatively, and the blocking portion 21 is driven to block the opening 10 from communicating with the outside after the filling member 2 moves upward. At regular times, when the water level in the water tank is full, the blocking portion 21 blocks the opening 10 from communicating with the outside, such that the solid cleaner is prevented from being dissolved without restraint after the water inside and outside circulates, causing waste. As a preferred implementation solution, in this embodiment, the apparatus further includes a cylinder 4. Two ends of the cylinder 4 penetrate through each other; one end of the cylinder 4 is provided with a flange 41, which extends internally; the blocking portion 21 is disposed in the cylinder 4; the flange 41 covers the blocking portion 21; and the opening 10 is blocked from communicating with the outside after the blocking portion 21 is fitted to the flange 41. In this embodiment, the filling member 2 axially moves along the cylinder 4 by being limited by the cylinder 4, so as to form a connection with the opening 10; and the filling member 2 is close to the alignable opening 10 after away from the container 1, such that a guiding effect on the movement of the filling member 2 is achieved, facilitating the achievement of circulation.

In this embodiment, the apparatus is connected to the container 1 by means of the other end of the cylinder 4. Preferably, the other end of the cylinder 4 is in threaded connection with the container 1.

In this embodiment, the apparatus further includes a cover plate 5. An upper end of the filling member 2 is fixedly connected to the cover plate 5 by extending out of the cylinder 4. The external diameter of the cover plate 5 is large, such that the filling member 2 may be limited from excessively falling during falling of the filling member 2, so as to control a discharge volume. A movement trajectory between the filling member 2 and the container 1 is also limited. The side of the cover plate 5 that faces towards the container is provided with a surrounding edge 51 that is exposed from the gap between the filling member and the opening 10; an external diameter of the cover plate 5 is greater than an external diameter of the cylinder 4; the surrounding edge 51 is at the periphery of the cylinder 4; and the surrounding edge 51 or the cover plate 5 is provided with a second through hole 50. At initial use, the apparatus for releasing a cleaner in a flush toilet is placed in the water tank, and the water in the water tank enters the container through the second through hole 50 via the gap between the filling member 2 and the opening, so as to fill the container with water. The surrounding edge 51 in this embodiment is at the periphery of the cylinder 4. The optimal height is that the surrounding edge 51 still can cover the gap between the filling member 2 and the opening 10 within a movable travel range of the filling member 2. That the surrounding edge 51 can cover the gap between the filling member 2 and the opening 10 does not mean that the surrounding edge 51 blocks the gap between the filling member 2 and the opening 10. In this embodiment, it is noted that the outermost surrounding edge 51 visually covers the gap between the filling member 2 and the opening 10 when being viewed from the outside. Preferably, the second through hole 50 is non-circular. The non-circular shape may be a triangle, a quadrilateral, a pentagon, a kidney shape, a fan shape, etc., which are not listed all for saving space. The main purpose of the non-circular shape is that, bubbles initially formed when external water enters the container 1 through the second through hole 50 is non-circular; and compared to a conventional circular shape, the bursting of the bubbles is facilitated or the bubbles are difficult to form. The shape is further limited herein, and is not intended to exclude a circular shape, but is merely the preferred option.

What is claimed is:

1. An apparatus for releasing a cleaner in a flush toilet, wherein the apparatus is placed in a water tank of a flush toilet during use, and comprises a container; the container is provided with an opening, and a cleaner is provided in the container; the apparatus comprises a filling member; the filling member is able to extend into the container from the opening, and there is a gap between the filling member and the opening; the filling member or the container is connected to a floating body;

relative movement between the container and the filling member occurs by means of a buoyancy effect, on the container or the filling member, of rising and drawdown of water in the water tank of the flush toilet, and a space that the filling member occupies the container changes;

during the drawdown of the water, the filling member occupies more space in the container, and the water in the container flows out; and during the rising of the water, the water outside the container flows into the container, and the filling member occupies less space in the container; and the container is provided with a through hole, and the through hole communicates with the opening via the space in the container.

2. The apparatus for releasing a cleaner in a flush toilet according to claim 1, wherein the filling member is connected to the floating body, and the buoyancy effect of the rising and drawdown of the water in the water tank on the filling member causes the filling member to move up and down under the buoyancy effect; and the container remains fixed to the water tank.

3. The apparatus for releasing a cleaner in a flush toilet according to claim 2, wherein the container is connected to a weight.

4. The apparatus for releasing a cleaner in a flush toilet according to claim 2, wherein the filling member is guided to be connected to the container when being close to or away from the container.

5. The apparatus for releasing a cleaner in a flush toilet according to claim 1, wherein the container is connected to the floating body, and the buoyancy effect of the rising and drawdown of the water in the water tank on the container causes the container to move up and down under the buoyancy effect; and the filling member remains fixed to the water tank.

6. The apparatus for releasing a cleaner in a flush toilet according to claim 5, wherein the opening of the container faces downward.

7. The apparatus for releasing a cleaner in a flush toilet according to claim 1, wherein the filling member is connected to a blocking portion; and after the water rises, the blocking portion is capable of blocking the opening from communicating with the outside.

8. The apparatus for releasing a cleaner in a flush toilet according to claim 7, further comprising a cylinder, wherein two ends of the cylinder penetrate through each other; one end of the cylinder is provided with a flange, which extends internally; the blocking portion is disposed in the cylinder; the flange covers the blocking portion; and the opening is blocked from communicating with the outside after the blocking portion is fitted to the flange.

9. The apparatus for releasing a cleaner in a flush toilet according to claim 8, wherein the other end of the cylinder is connected to the container.

10. The apparatus for releasing a cleaner in a flush toilet according to claim 9, wherein the other end of the cylinder is in threaded connection with the container.

11. The apparatus for releasing a cleaner in a flush toilet according to claim 8, further comprising a cover plate, wherein an upper end of the filling member is fixedly connected to the cover plate by extending out of the cylinder.

12. The apparatus for releasing a cleaner in a flush toilet according to claim 1, wherein the cleaner in the container is a solid cleaner.

13. The apparatus for releasing a cleaner in a flush toilet according to claim 1, wherein the through hole is below the opening; the hole diameter of the through hole is 0.1 mm to 12 mm; and the through hole is located in an upper middle section of the container.

14. The apparatus for releasing a cleaner in a flush toilet according to claim 11, wherein the side of the cover plate that faces towards the container is provided with a surrounding edge that is exposed from the gap between the filling member and the opening; an external diameter of the cover plate is greater than an external diameter of the cylinder; the surrounding edge is at the periphery of the cylinder; and the surrounding edge or the cover plate is provided with a second through hole.

15. The apparatus for releasing a cleaner in a flush toilet according to claim 14, wherein the second through hole is non-circular.

16. The apparatus for releasing a cleaner in a flush toilet according to claim 14, wherein the second through hole has an overlap with the gap in a vertical straight line.

* * * * *